US005502755A

United States Patent [19]

Nagel et al.

[11] Patent Number: 5,502,755

[45] Date of Patent: Mar. 26, 1996

[54] HIGH SPEED, HIGH ACCURACY PARTS COUNTING SYSTEM

[75] Inventors: Thomas O. Nagel, Blairstown, N.J.; Daniel J. Ellis, Wilkes-Barre, Pa.

[73] Assignee: Trion Industries, Inc., Wilkes-Barre, Pa.

[21] Appl. No.: 419,171

[22] Filed: Apr. 10, 1995

[51] Int. Cl.[6] ..... G06M 7/00

[52] U.S. Cl. ..... 377/6; 377/10

[58] Field of Search ..... 377/6, 10

[56] References Cited

U.S. PATENT DOCUMENTS

| | | | |
|---|---|---|---|
| 4,139,766 | 12/1979 | Conway | 377/6 |
| 4,259,571 | 3/1981 | Dubberly | 377/6 |
| 4,390,779 | 6/1983 | Heikel | 377/6 |
| 4,782,500 | 11/1988 | Lyngsie | 377/10 |
| 4,868,901 | 9/1989 | Kniskern et al. | 377/6 |
| 5,145,051 | 9/1991 | Hoppmann | 198/396 |

OTHER PUBLICATIONS

"Service Engineering Inc.", Hoppmann Corporation, one page Apr. 9, 1994.

"Innovators Research & Development", Innovators USA Inc., two pages. Apr. 9, 1994.

*Primary Examiner*—John S. Heyman

*Attorney, Agent, or Firm*—Schweitzer Cornman & Gross

[57] ABSTRACT

A high speed, high accuracy parts counting system is disclosed. The new system utilizes known types of centrifugal feeder devices with novel modifications relating to the sensing and control of individual workpieces, enabling workpieces to be counted and processed at much greater speeds than before, while equaling or improving accuracy. The new system makes no attempt to separate individual workpieces for counting purposes, enabling operations to be carried out at greater speeds. Counting of workpieces in an unseparated group of such workpieces is accomplished by electronic measurement of movement of the centrifugal feeder between the leading and trailing edges of a group of unseparated workpieces. The counting of a predetermined number of workpieces is thus a function of the counting of pulses and is independent of the separation or non-separation of workpieces during counting. Provision is also made for high speed collection and discharge of counted groups of workpieces.

20 Claims, 7 Drawing Sheets

HIGH SPEED, HIGH ACCURACY PARTS COUNTING SYSTEM

BACKGROUND AND SUMMARY OF THE INVENTION

There is a consistent requirement in the commercial marketplace for the packaging of a specific number of elements in a container, and a wide variety of systems are available for this purpose. One of the known techniques involves weighing of an accumulated batch of workpieces and comparing the weight against a calculated total weight of the desired number of elements. This technique frequently has accuracy limitations, necessitating the practice of overfilling or overcounting to avoid the possibility of a short count. This technique also tends to have limitations on speed at which operations take place.

Other known techniques involve passing the workpieces or elements, one at a time, past a counter device, usually a photosensor or other optical device requiring no contact with the part being counted. A particularly advantageous form of such a system involves the use of precision centrifugal feeders, such as those marketed by the Hoppmann Corporation, of Chantilly, Va. The Hoppmann centrifugal feeder utilizes a rotating bowl having a confined ledge or flange arranged to receive the parts in a single-file order, that is, the flange is too narrow to support two elements in side-by-side relation, and means are provided for preventing workpieces from stacking vertically, one above the other. As individual workpieces are carried by the flange-of the rotating bowl, means are provided for inducing linear separation between successive elements, after which they are optically counted by momentary interruption of a light beam as individual workpieces pass by. As soon as the workpieces pass the counter, they are caused to exit the system through a sidewall opening, allowing momentum and centrifugal force to discharge the workpiece. When a desired number of workpieces has been counted, the continued flow of workpieces toward the exit opening is interrupted, typically by the action of an air jet which blows workpieces off the flange of the rotating bowl before they can reach the exit opening. As soon as the counted batch of workpieces has been collected and removed, counting of the second batch can be initiated.

While the above described system is satisfactory in many respects, certain significant speed limitations are imposed by the need for separating and individually counting the workpieces.

In accordance with one feature of the present invention, the speed at which the counting of workpieces takes place may be greatly increased without sacrifice of accuracy. In the system of the invention, provision is made for electronically counting minute increments of advancing movement of the workpiece conveyor, preferably the bowl flange of a Hoppmann-type centrifugal feeder device. For any particular workpiece to be processed, the length of that workpiece can be accurately ascertained, and the total length of a given number of such workpiece can also be accurately ascertained. In the system of the invention, once the total length of a workpiece, and the desired number of workpieces, are known, that information is converted to an appropriate number of electronically countable motion increments of the conveying device. The movement of workpieces past a counting point is detected by a sensor, preferably an optical switch arranged to respond to a light beam. At any time that the light beam is interrupted, increments of movement of the conveyor means are electronically counted, and a total of increments is accumulated.

In the system of the invention, it is immaterial whether the workpieces are separated individually or pass by the sensor in tightly contacting groups. For example, if a group of three workpieces pass by the sensing point in end-to-end contact, the light beam is caused to be continuously interrupted throughout the passage of all three workpieces. However, motion increments of the conveying flange, corresponding to the combined length of all three workpieces, are detected and counted during the light beam interruption. Once the total increment count equals the precalculated count for the desired total number of workpieces, the continued passage of workpieces to the exit point is interrupted while the just-counted batch is removed, after which counting of a new batch is initiated.

By eliminating the need for effecting linear separation of successive workpieces during their passage past the sensing means, it becomes possible to operate the workpiece conveyor at much higher speeds. This is particularly true in the case of the preferred conveyor, namely a rotating bowl, because manipulation of the workpieces becomes increasingly difficult with higher rotating speeds, partly because of the greater centrifugal forces involved, and partly because of the increased momentum of the workpieces.

In known systems for counting workpieces using, for example, Hoppmann-type centrifugal feeders, it is typical to employ air jet diverter means to displace workpieces from the flange of the rotating bowl during the interim period between the counting of successive batches. In the system of the present invention, because of the significantly higher rotating speeds made possible, and the higher centrifugal forces engendered thereby, air jet deflector means is somewhat less reliable than is desired, resulting in the potential for the passing of occasional uncounted workpieces. In the system of the present invention, positive mechanical deflector means are deployed in the short interval between the counting of successive batches, reliably preventing the passage of uncounted workpieces to the exit opening. In addition, associated air jet deflector means is positioned somewhat upstream of the mechanical diverter. The air jet diverter removes the majority of workpieces from the flange of the rotating bowl, and any workpieces which the air jet fails to divert are shortly thereafter positively deflected off of the flange by the deployed mechanical diverter. The mechanical diverter, in combination with an upstream air jet diverter assures positive control of the parts while minimizing any damage to workpieces from impacting the mechanical diverter while travelling at high speed.

Another feature incorporated in a preferred embodiment of the invention is a high speed collection-discharge system for accumulating a counted batch of workpieces in a high speed manner and, when predetermined batch count has been realized, discharging the accumulated batch of workpieces in the shortest practical time, to enable counting of a new batch to commence with a minimum of delay. To advantage, this can be realized by providing a confined conduit for guiding workpieces from the exit opening of the centrifugal feeder to a batch collector, with controlled air flow to accelerate the travel of workpieces through the conduit. The batch collector device advantageously is a gravity fed collecting box, with hinged bottom panels for releasing and discharging a batch of counted workpieces into a suitable container. Advantageously, the collecting box has a perforate bottom structure, such that augmented air flow used in conveying workpieces toward the collecting box exits through the bottom of the box and thus serves to assist gravity in transporting workpieces quickly to the bottom of the collection box.

For a more complete understanding of the above and other features and advantages of the invention, reference should be made to the following detailed description of a preferred embodiment of the invention and to the accompanying drawings.

DESCRIPTION OF PREFERRED EMBODIMENTS OF THE INVENTION

Figure 1:
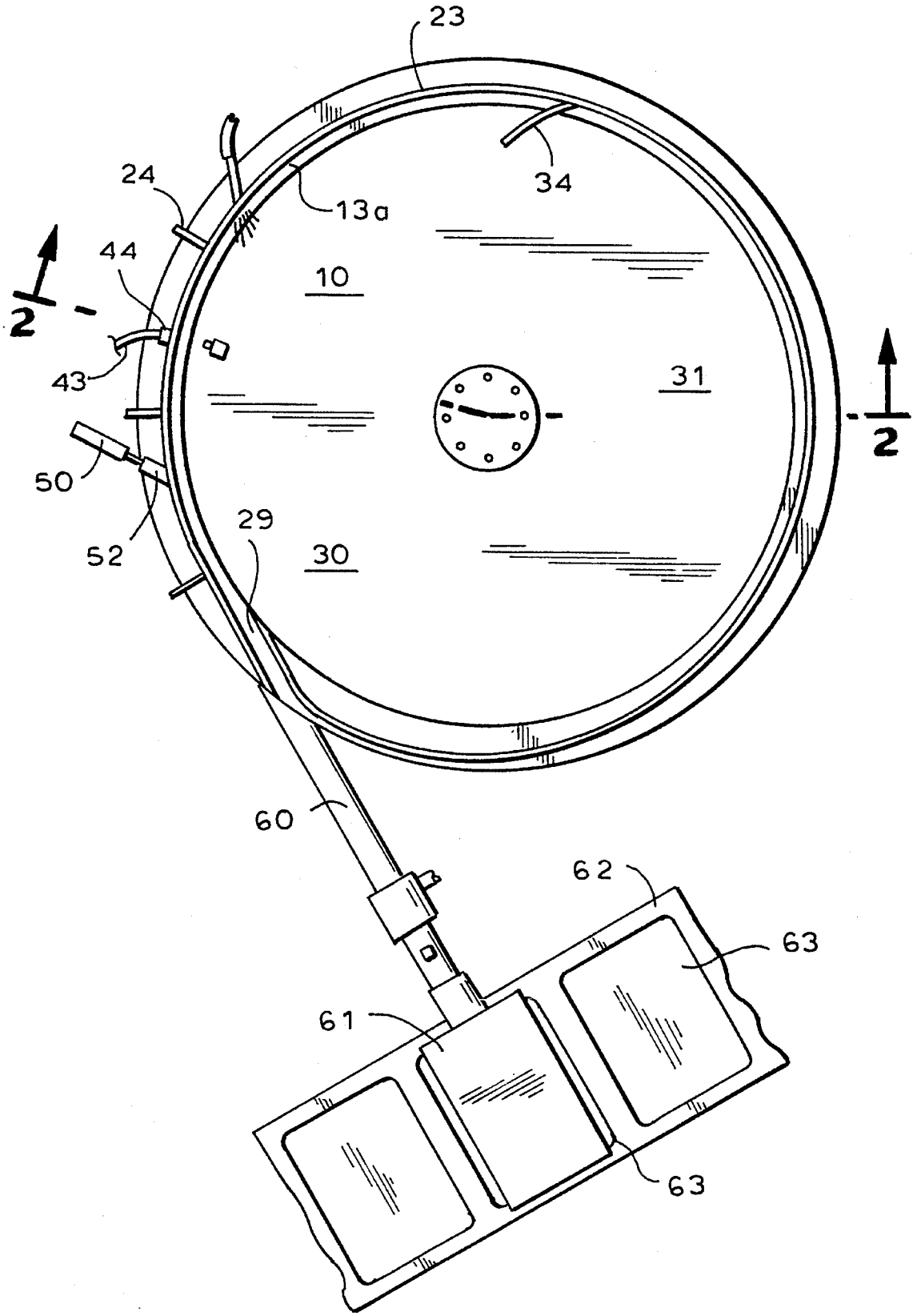
FIG. 1 is a simplified top plan view of a high speed counting system incorporating features of the invention.
Figure 2:
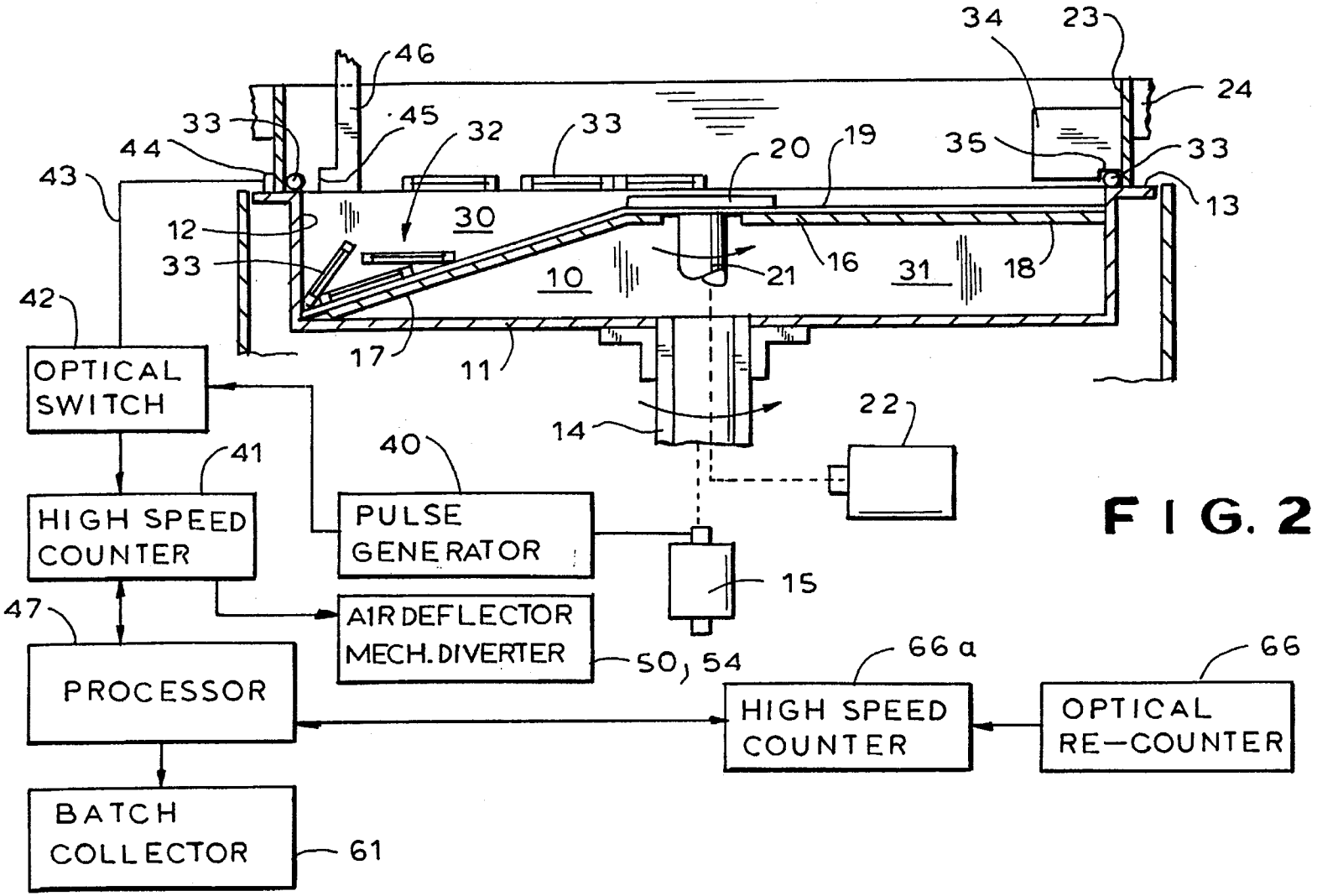
FIG. 2 is a representative cross sectional view of the system of FIG. 1, as taken, for example, on line 2–2 thereof and including a representative flow diagram of control functions.
Figure 3:
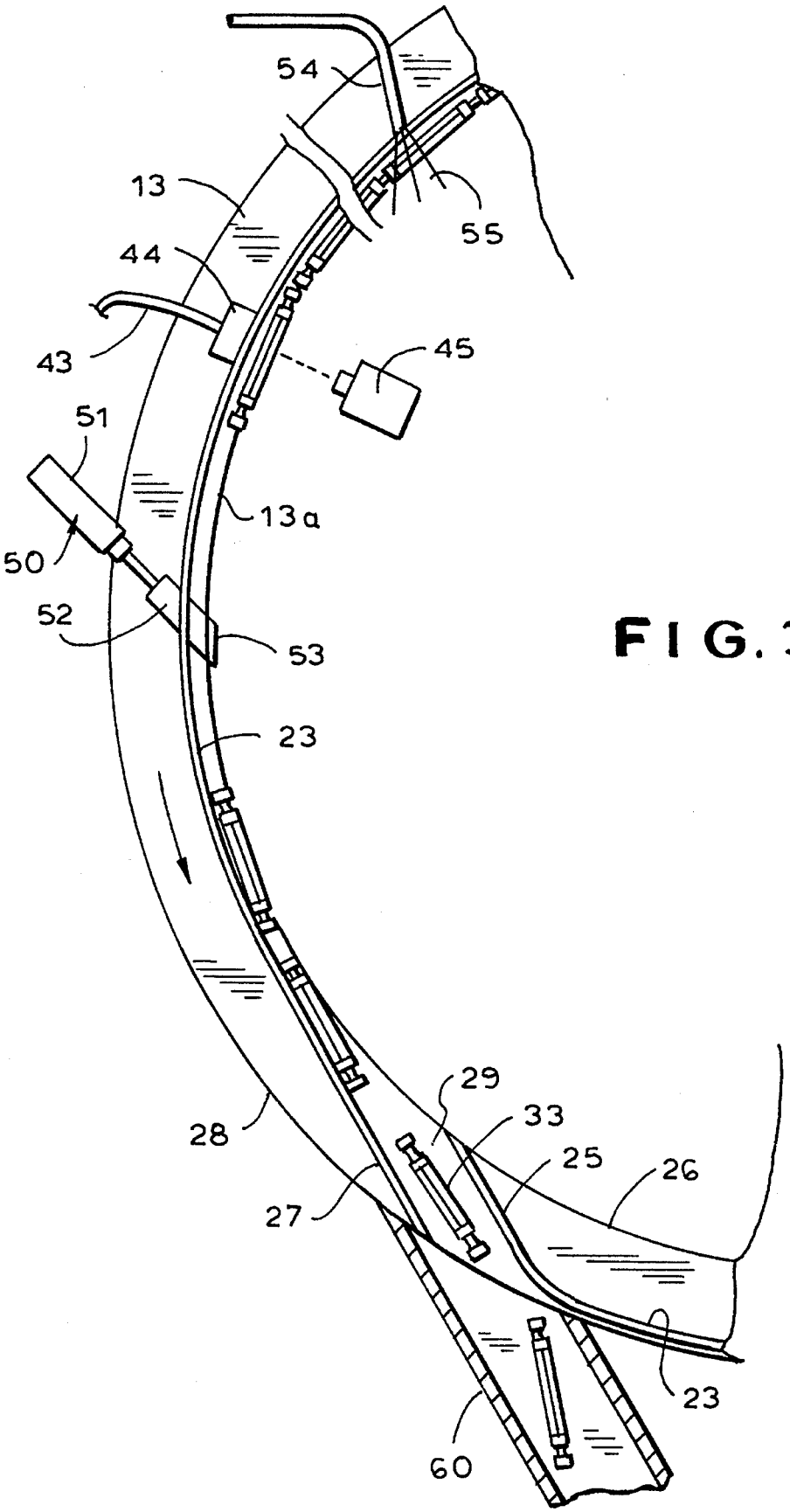
FIG. 3 is an enlarged, fragmentary view of a portion of the system of FIG. 1, showing details of various features of the system.

Referring now to the drawings, and initially to FIGS. 1–3 thereof, the reference numeral 10 designates in a general way a centrifugal feeding device which preferentially can be of a type marketed by Hoppmann Corporation of Chantilly, Va. and referred to for example by Hoppmann Model Designations FT-40 or FT-50 ("FT" being a shorthand designation for "Feeder Tangential").

A conventional Hoppmann centrifugal feeder includes a rotatable bowl 11 having a generally vertical sidewall 12 and an outwardly extending horizontal, flat conveying flange 13. Inasmuch as details of construction of the Hoppmann feeder are well known, and it is a commercially available product, many structural details are omitted from this description for simplification. In general, the bowl 11 is suitably mounted, for example on a tubular shaft 14, for controlled rotation by a drive motor 15.

Within the hollow bottom of the bowl 11 is a non-rotating false bottom structure 16, which is asymmetrically arranged to have a portion 17 angling downward at one side to a level well below the conveying flange 13. At the opposite side, the fixed false bottom has a portion 18 which is elevated to a level at or slightly below the level of the flange 13, with transitional portions in between. The false bottom 16 may be adjustable vertically for processing of parts of different size.

In addition to the non-rotating false bottom 16, there is a rotating, flexible bottom 19, in the form of a flexible disc of plastic material, secured at the center to a hub 20 rotated by a shaft 21. The shaft 21 is connected to a drive motor 22, schematically indicated in FIG. 2.

Positioned directly above the conveying flange 13, and either resting on the flange or supported just slightly above it, is a confining fence 23, which is formed of flexible plastic or sheet metal and which is positioned relative to the conveying flange 13 by means of a plurality of adjustable supports 24, which are spaced radially about the entire circumference of the unit and serve to support the entire length of the confining fence. Suitable adjusting screws or the like (not shown but conventional in the Hoppmann commercial machine) are provided for adjusting the fence 23 radially toward or away from the center of the bowl 11, as well as vertically. The arrangement is such as to expose on the inside of the confining fence a limited inside marginal portion **13*a* of the conveying flange. The exposed marginal portion 13*a* is wide enough to support only a single workpiece, as is particularly evident in FIGS. 2 and 3, such that it is impossible for two of the workpieces to be supported in side-by-side relation. Thus, the position of the confining fence 23 is a function of the size of the workpieces to be counted, and once adjusted to accommodate a particular size workpiece, the confining fence 23** remains fixed in its position.

As shown in FIG. 3, the "upstream" end of the fence 23 is preferably angled over to a point approximately at the inner surface 26 of the sidewall 12. At approximately the same location, the "downstream" end 27 of the fence angles generally outward toward the outer edge 28 of the conveying flange. The two end portions 25, 27 thus define a generally tangential exit opening 29. When the system is in operation, and the bowl 11 is being rotated, any parts conveyed by the flange margin **13*a* to the exit opening 29** will automatically exit through the opening as a result of the tangentially directed momentum of the workpieces.

With reference to FIGS. 1 and 2, the low portion 17 of the non-rotating false bottom is typically located in the region 30 (FIG. 1) generally adjacent the exit passage 29. The elevated portion 18 is typically located in a generally diametrically opposite area 31, as indicated in FIG. 1. A supply 32 of workpieces 33 (FIG. 2) is maintained in the low area 30. Typically, this is accomplished by means of a sensing wand (not shown) or the like which senses the level of a supply of workpieces in the low portion 30. When the height of the supply becomes lower than desired, a supply source (not shown) is actuated to dump additional workpieces into the low portion of the bowl.

In typical operation, the bowl 11 is rotated at a desired speed by controlling the speed of the motor 15. The flexible bottom element 19 is also rotated at a controllable speed by the motor 22, and the speed of the bottom 19 is not necessarily the same as that of the bowl. The proper speeds for the bowl 11 and flexible bottom 19 generally will be empirically determined for different workpieces. When optimal speed relationships are achieved, the individual workpieces 33 are progressively urged radially outward along the flexible bottom 19, which typically is formed of a low friction material. As workpieces reach the elevated portion 18, individual ones of the workpieces will be urged by centrifugal force onto the margin **13*a* of the conveying flange 13 and will thence be conveyed by the flange 13 around the bowl, being confined thereon by the fence 23**.

In the event that two workpieces 33 get piled one on top of the other or are partially overlapped, such workpieces are removed from the flange by a loading guide 34 which is mounted to extend radially inward from the inner surface of the fence 23 and has a gauged opening 35 therein which will allow passage of only a single, in-line workpiece 33 properly positioned and supported on the flange margin **13*a*. Any other parts are swept aside and dropped back into the bowl 11. As reflected in FIG. 1, the loading guide 34 is located at a point downstream of the area 31 of maximum elevation of the fixed false bottom 18, at a point where the flexible bottom 19 is sufficiently below the level of the flange 13** that parts cannot be transferred from the bowl to the conveying flange.

In a continuing operation, the bowl 11 and flexible bottom 19 can be rotated at relatively high speed, and individual workpieces will be successively loaded on to the flange margin 13*a* in the region 31. Extra or misoriented workpieces are swept away by the loading guide 34, leaving only a succession of single-file, in-line workpieces 33 supported on the flange margin 13*a* in a purely random spacing, with open space between some workpieces and with other workpieces in direct end-to-end contact, generally as reflected in FIGS. 2 and 3.

In a preferred embodiment of the invention, the drive train for the rotating bowl 11 is provided with a pulse generating device which per se may be of any suitable type, of which many are known to those skilled in the art. The pulse generator is arranged to generate a detectable electrical pulse for a given small increment of rotation of the bowl 11, which can be translated into a corresponding linear (circumferential) motion of the flange margin 13*a*. In an advantageous form of the invention, the pulse generator operates through a gear train connected to the drive for the bowl 11, or forming part of that drive. In a unit having a bowl of about forty inches in diameter, the pulse generator advantageously can be set to deliver approximately 8000 pulses per revolution of the bowl. For a forty inch bowl, this is approximately one pulse for each 1/64th inch of travel of the flange margin 13*a*. For reasons to be explained hereinafter, it is not necessary to calculate the exact linear distance travelled by the flange margin 13*a* per generated pulse, as the system can be instantly calibrated for a given size of parts, without performing calculations.

With reference to FIG. 2 of the drawings, the reference numeral 40 designates the pulse generator facility as described. The pulse output of the pulse generator is either transmitted to a pulse counter 41 or blocked, according to the condition of an optical switch 42. The optical switch is connected to a fiber optic cord 43 having a remote end 44 located on the confining fence 23, a short distance in advance of the exit opening 29. The fiber optic cord is positioned to receive light from a light source 45 mounted inside the bowl 11 by means of a suitable bracket 46. The optical switch 42 thus normally detects a light beam from the source 45 and functions to deactivate the pulse counter. With the pulse counter deactivated, pulses emitted by the pulse generator 40 do not reach the pulse counter and thus are not registered. The instant the light source 45 is blocked by the interposition of a workpiece 33 (see FIG. 2) the optical switch 42, which is an extremely high speed device, for example an Allen-Bradley 42SFR-6503 Ser. B photo switch, allows pulses to pass through to the pulse counter 41, which causes the counter to commence counting and accumulating the total of pulses. As soon as the workpiece clears the light beam, the optical switch is actuated to interrupt the passage of subsequent pulses to the pulse counter 41.

When the light source 45 is interrupted by a succession of workpieces contacting each other end-to-end, the pulse counter begins to receive pulses as soon as the first workpiece interrupts the light beam, and the flow of pulses continues until the light beam is cleared by the passage of the last of the succession of contacting workpieces. The pulse counter 41, during the passage of the succession of contacting workpieces, has registered pulses corresponding to the combined length of all of the contacting workpieces so that, in effect, all workpieces have been counted.

A processor 47 associated with the pulse counter 41 is operative to set the pulse counter to respond when the total pulse count reaches a predetermined level. For example, if the system is set to count one inch workpieces in batches of fifty, and the pulse generator generates sixty-three pulses during the passage of each workpiece, the processor sets the pulse counter to respond to an accumulated count of 63×50 or 3150 pulses. When this count has been reached, the system recognizes that the counting of fifty workpieces has been accomplished, regardless of whether the pieces have been counted individually or in various groups of two or more or, what is more likely, in various combinations of individual and grouped workpieces.

When the last workpiece of a batch has been detected by the pulse counter 41, the passage of additional workpieces into the exit opening 29 must be temporarily interrupted. To this end, the preferred apparatus incorporates a mechanical diverter device 50, which is located between the light sensor 44 and the exit opening 29. The mechanical diverter includes a high speed actuator device 51, preferably either a solenoid device or an air actuator, which actuates a diverter blade 52 between retracted position (FIG. 1) and an extended position (FIG. 3). Normally, the diverter blade 52 is in a retracted position, in which its front surface 53 is generally flush with the inner surface of the confining fence 23. When the desired total pulse count has been detected by the pulse counter 41, the actuator 50 is operated, so that the diverter blade 52 extends across the flange margin 13*a* and causes any further workpieces reaching that point to be deflected radially inward and dropped back into the bowl 11.

Because the bowl 11 is expected to be rotating at relatively high speed, with resulting high velocity of movement of the workpieces 33, repetitive impacting of the workpieces against the deflector blade 52 could be detrimental to the workpieces. Accordingly, the system of the present invention provides for an air jet device 54, located a short distance upstream from the mechanical deflector device 50, which is actuated simultaneously with the mechanical deflector 50 and functions to direct a high pressure jet of air through an opening 55 in the confining fence. The air jet 54 serves to blast most of the workpieces off of the flange margin 13*a*. In the event that the air jet does not effectively remove every workpiece, and experience indicates that the air jet frequently is not 100% effective when the bowl is operated at high speeds, those parts are ultimately deflected positively by the mechanical deflector blade 52.

Figure 4:
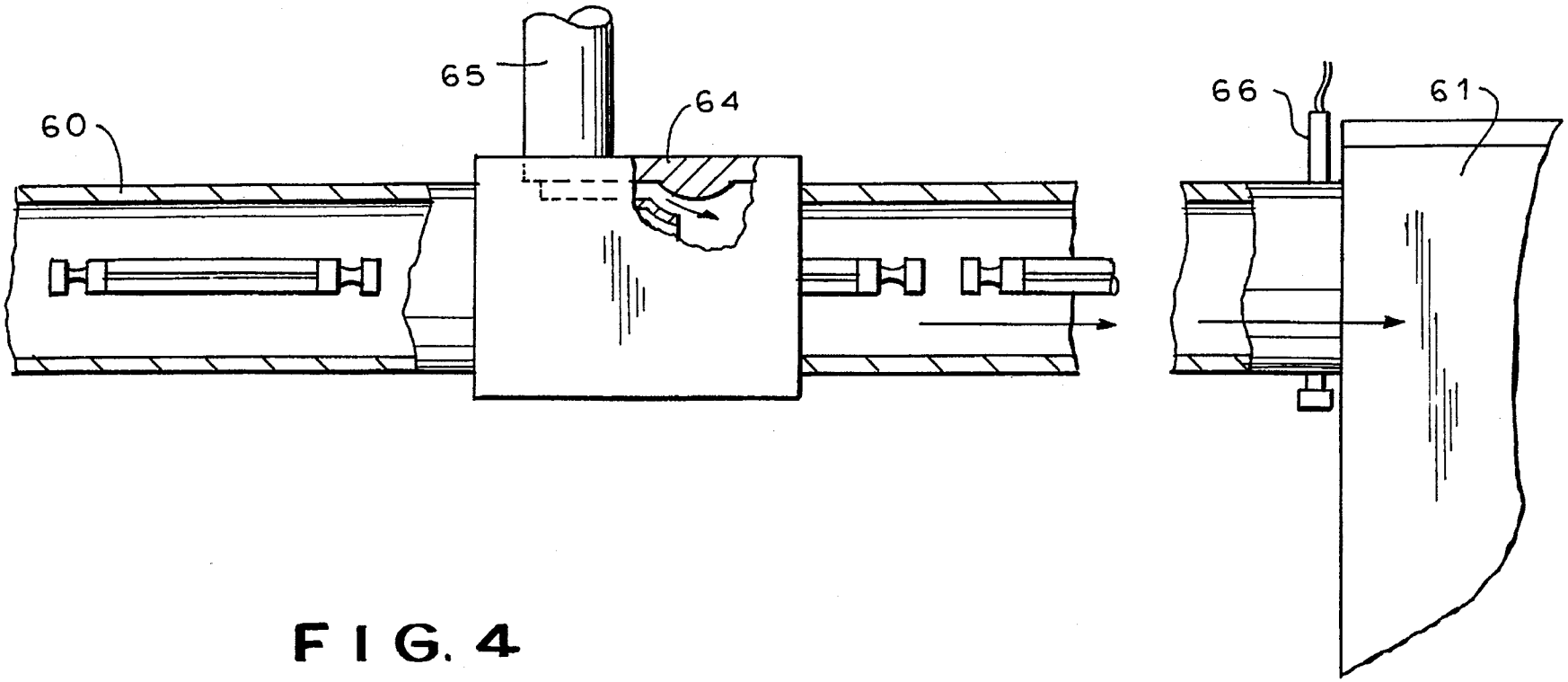
FIG. 4 is a fragmentary cross sectional view of a discharge conduit for conveying counted workpieces to a collecting box.

Once a batch count has been completed, all of the workpieces of the counted batch are collected and disposed of before initiating a new batch count. For this reason, it is particularly desirable to process a counted batch and prepare for the next batch as soon as possible. In the preferred and illustrated form of the invention, this is accomplished in part by accelerating the movement of counted workpieces toward and into a collecting box, and effecting a rapid discharge of a completed batch from the collecting box as soon as possible after the count is complete. With reference to FIGS. 1, 3 and 4, a discharge duct 60 extends tangentially from the feeder device 10, more or less as a continuation of the tangential exit opening 29. The arrangement is such that any workpieces exiting through the opening 29 automatically are discharged into the duct 60 by the forward momentum of the workpiece imparted by its movement with the rotating conveyor flange. A collecting box 61 is connected to the discharge end of the duct 60, so that all parts entering the duct are deposited into the collecting box. Preferably, the collecting box is located directly above a batch conveyor 62 containing individual receiving bins 63. During a counting operation, one of the receiving bins is located directly underneath the collecting box 61, as shown in FIG. 1.

To particular advantage, a Venturi nozzle device 64 is interposed in the discharge duct 60. The Venturi nozzle advantageously may be a commercial product sold under the name of Tornado Air Mover, by Innovators S.A. and available through Innovators USA, Inc., Montgomeryville, Pa. The Venturi nozzle is installed in-line in the duct 60, so that workpieces passing through the duct pass through the Venturi nozzle as well. The nozzle 64 is provided with a high pressure air supply tube 65, which injects air into the duct, through an annular nozzle adjacent to the walls of the duct, directing a flow of high velocity air in a downstream direction. The result is both to impart a substantial suction effect in the upstream portions of the discharge duct 60 and a high velocity discharge stream in the downstream portions of the duct, leading to the collecting box 61. Because of the air rushing into the inlet end of the duct 60, adjacent to the exit opening 29, workpieces entering the duct are rapidly accelerated by the air flow and then accelerated again by the high velocity downstream flow as the workpieces pass through the Venturi nozzle.

The acceleration of the workpieces through the discharge duct 60 has multiple advantages. Perhaps the most obvious is that it expedites the clearing of counted workpieces after a batch count has been realized, enabling a new batch count to be started more expeditiously. Additionally, acceleration of the individual workpieces as they enter the discharge duct 60 typically results in a linear separation of the workpieces, preventing possible jam ups in the duct. Moreover, because the workpieces have a linear separation resulting from the action of the Venturi nozzle, it is feasible to perform an optional secondary count, by means of a re-count sensor 66, preferably located at the discharge end of the duct. The re-count sensor 66 is associated with a high speed counter **66*a***, which accumulates a count on a part-by-part basis.

The secondary or re-count sensor 66 and its associated counter **66*a* would not appropriately be used for a primary control function, but principally for count verification. The sensor 66, located at the discharge end of the duct 60, assures that all of the workpieces counted by the primary counter are in fact received by the collecting box 61. For example, if the primary control system was actuated to complete a batch after a fifty piece count, and at the end of the batch operation the sensor 66 has detected the arrival at the collection box of only forty-nine or fewer pieces, the processor 47 can re-set the primary counter 41** to deliver one additional piece.

In addition, the secondary counter can alert the machine operator to possible problems resulting from debris or contamination in the bowl 11 that could result in false counting. In general, any disagreement between the primary and secondary counters would be reason for the operator to carefully inspect the equipment for foreign objects or materials, etc.

To advantage, the relatively high velocity air flow through the duct 60 is caused to be discharged through the bottom of the collecting box 61. As a result, there is an air flow in the collecting box directed downwardly through the box, and this air flow assists in conveying workpieces rapidly to the bottom of the box, all with the objective of optimizing the speed at which the batching procedure may be completed.

Figure 5:
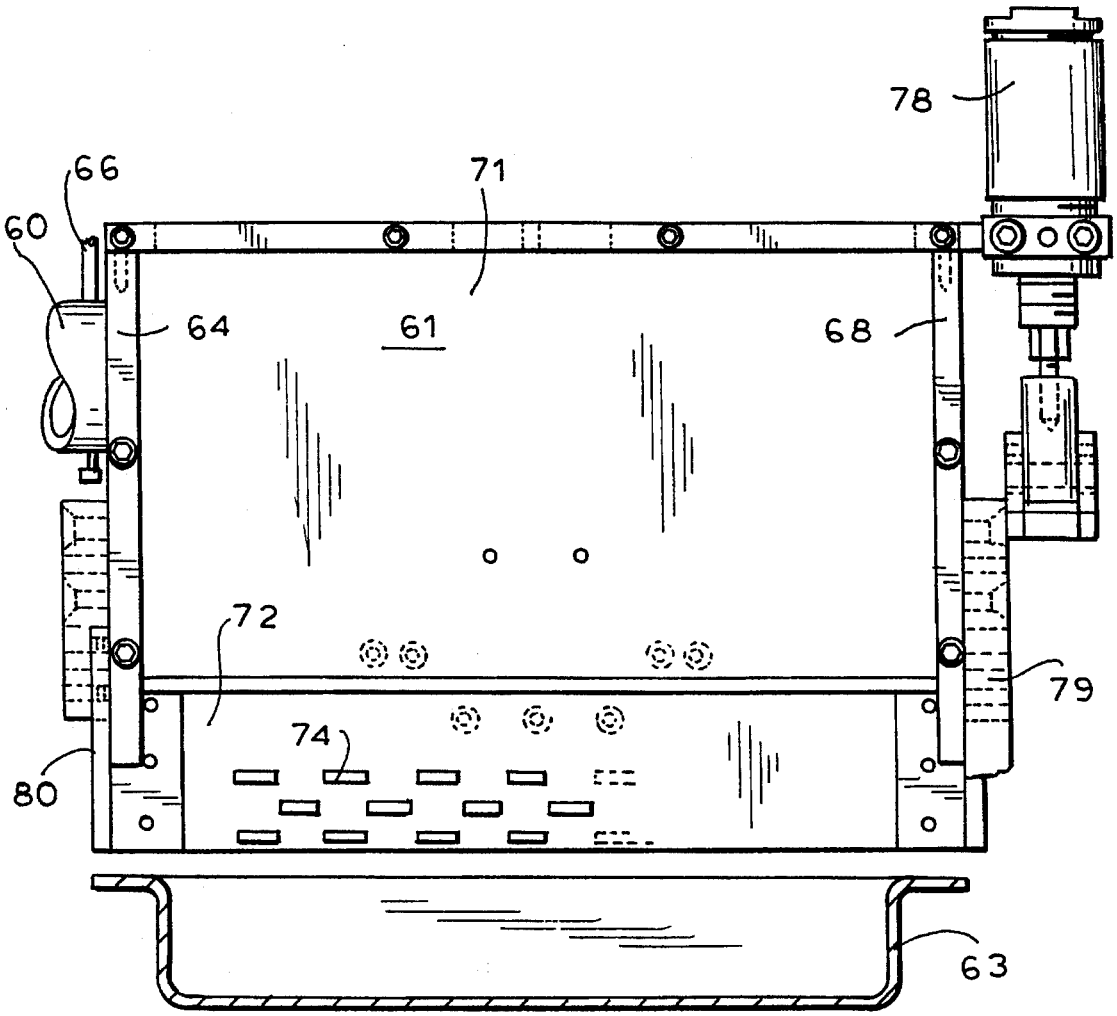
FIG. 5 is a side elevational view of an advantageous form of collecting box used in the preferred system of the invention for collection of counted batches of workpieces and discharge thereof into individual containers.
Figure 6:
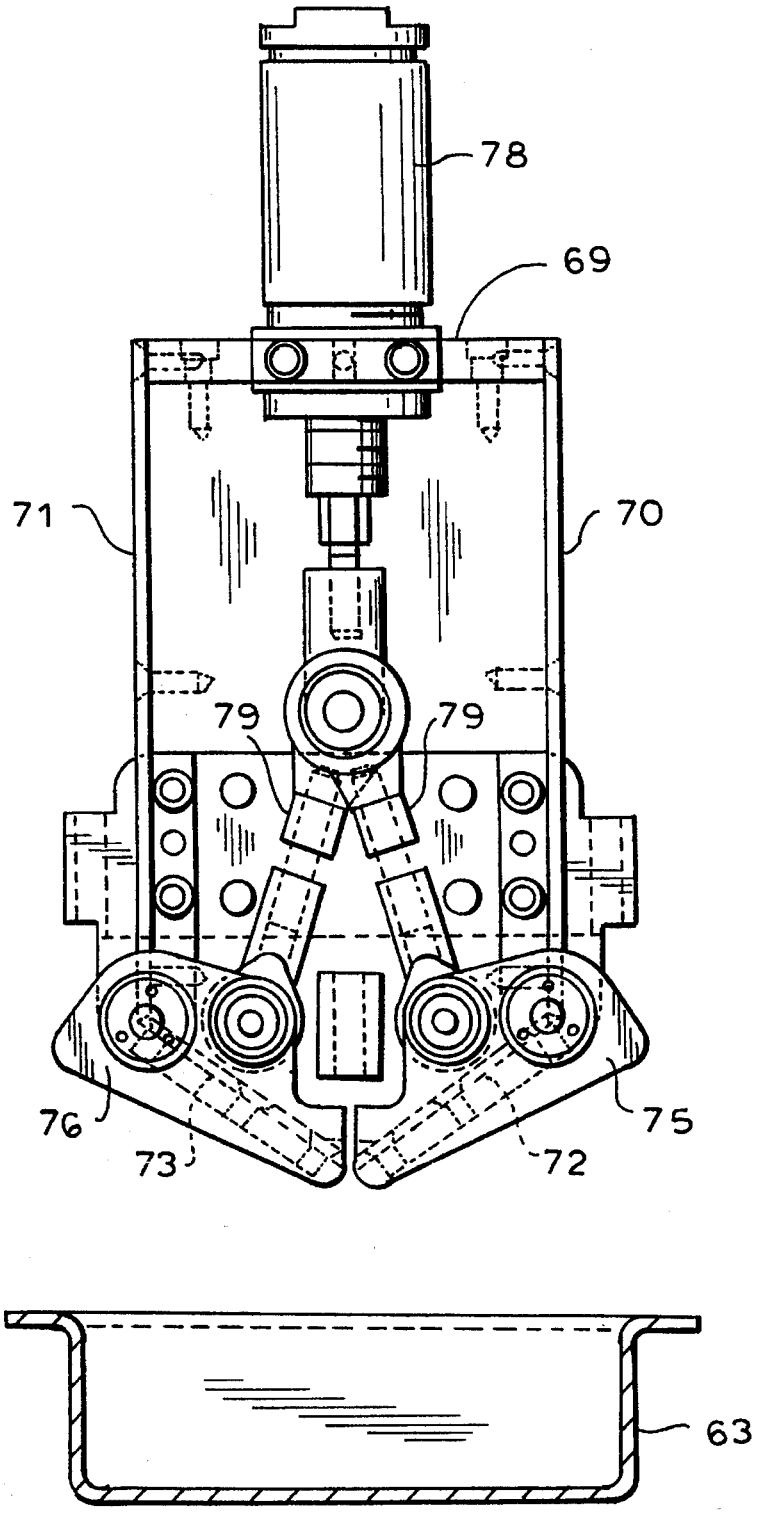
FIG. 6 is an end elevational view of the collecting box of FIG. 5, with the bottom panels closed.
Figure 7:
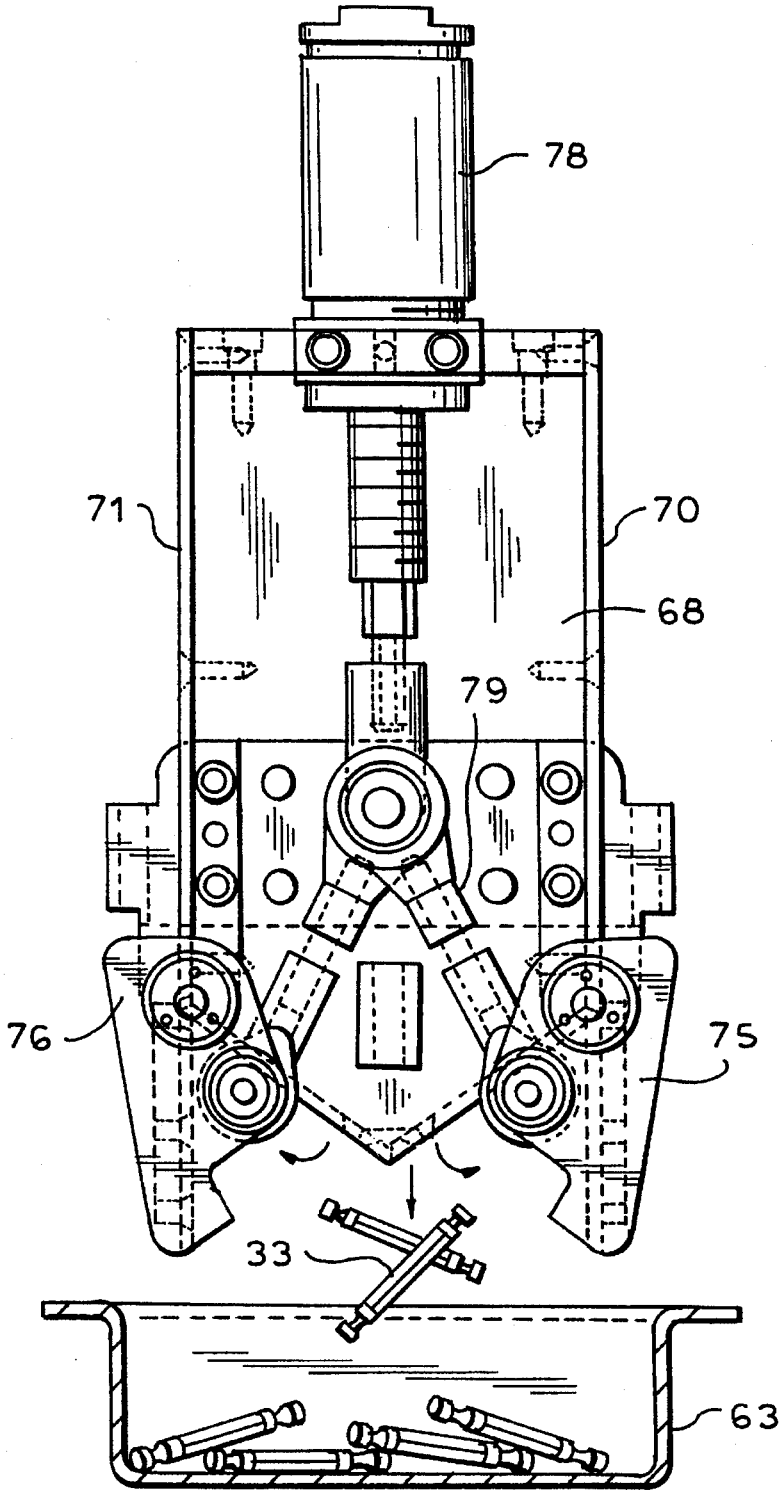
FIG. 7 is an end elevational view similar to FIG. 6 but with the bottom panels open for discharging a collected batch of workpieces.

In the illustrated and preferred form of the invention, the collecting box, shown particularly in FIGS. 5–7, comprises a first end wall 67 with which the exit end of the discharge duct 60 communicates. An opposite end wall 68 is spaced far enough away from the first end wall to accommodate workpieces of the maximum length contemplated for the system. The collecting box also includes a top wall 69 and spaced sidewalls 70, 71, with the walls 67–71 forming a generally imperforate, open bottom receptacle.

A bottom structure for the collecting box is formed by two panels 72, 73, which are inclined downwardly and inwardly toward the center of the box. The bottom panels are provided with a multiplicity of openings 74 more or less over the full areas thereof, intended to provide for the relatively uninhibited outflow of air which is entering the box through the duct 60. Desirably, substantially all of the air entering the box through the duct 60 is required to exit the box through the bottom area, primarily through the openings 74. After the bottom panels 72, 73 are connected to hinge panels 75, 76, which are pivotally mounted on the end wall 68, and by similar hinge panels 77, pivotally mounted on the end wall 67. High speed opening and closing of the bottom panels is provided by an actuator 78, preferably either a solenoid or air cylinder, which is connected through pivot rods 79 with the hinge panels 75, 76. When the cylinder or solenoid 78 is actuated, the bottom panels are rapidly opened to a vertical orientation, as indicated in FIG. 7, causing a collected batch of workpieces in the bottom of the box to be dumped into a receiving container 63, with the action of gravity being somewhat augmented by the downflow of air through the now open bottom of the collecting box. A quick opening and closing movement of the bottom panels is sufficient to completely empty the collecting box and prepare the box for receiving a subsequent batch. To this end, the actuator 78 advantageously can be controlled by the processor 47, such that the discharge panels are opened after an appropriate short delay period following actuation of the mechanical diverter 50, in order to give time for the last workpieces to travel from the diverter to the collecting box.

If desired, the hinge panels 80, mounting the bottom panels at the end of the box opposite the actuator 78, can be joined at the center by way of meshing gear teeth (not shown) to assure synchronism of movement of the panels at that end of the collecting box.

Actual calibration of the equipment for the processing of workpieces of a particular kind can be accomplished quickly and accurately without necessitating measurement of average lengths of the workpieces. Instead, all that is necessary is to manually load the bowl 11 with a known number, for example twenty, of workpieces of the desired size, and also to enter that number into the processor 47. The equipment is then started up and the test load of pre-counted workpieces is caused to be conveyed in the usual manner past the sensing point 44 and out through the exit opening 29. When all of the known number of pieces has been transferred from the bowl to the collecting box, the processor 47 divides the total number of pulses that have been accumulated by the pulse counter 41 by the number of parts processed to obtain a pulse-per-part value, which is stored for future reference. As in the example previously given, if the average length of a workpiece corresponds to sixty-three pulses generated by rotation of the bowl 11, the pulse counter will have registered the accumulation of 1260 pulses during the feeding of twenty workpieces, and will calculate and store the pulse-per-part value of 63 for that part. After the initial calibration, the pulse-per-part count thus derived can be used as a multiplier for a greater or lesser number of parts. For example, to count fifty parts, the operator need merely to enter the part identification and the number 50 into the processor 47, and the processor will automatically set the pulse counter 41 to end the batching operation when the pulse count reaches the appropriate pulse total (3150).

Recalibrating the system for a new size workpiece merely involves following the steps of the above paragraph, and can be accomplished in a few moments. For repetitive operations, of course, workpieces of different size can be accommodated by simply setting of the processor 47 to the workpiece identification and the desired part count.

The system of the invention, while by no means limited thereto, is uniquely advantageously for the counting of rod-like workpieces to be assembled in kits for construction toy sets. The rod-like elements are of a variety of sizes, for example from less than an inch in length to almost eight inches in length. Accurate counting of the parts for the kit is essential, in order to enable the construction of devices according to plans included in the kit. In the system of the invention, parts of this type can be processed with great precision and at much higher speeds than has been feasible heretofore, because there is no necessity for linear (circumferential) separation of workpieces to enable precise counting to take place. Where such separation is necessary, as in ordinary optical counting, the equipment must be run at considerably lower speeds, in order that the workpieces can be properly separated as they approach the counting sensor. With the system of the present invention, it is absolutely immaterial whether the workpieces are separated or in end-to-end contact or (as is typical) some mixture of contacting and separated parts.

In the system of the invention, provision is made for assuring that the parts are being conveyed in single file fashion, with no bunching of parts side-by-side and/or one above the other. This is easily accomplished by means of a conventional loading guide device located downstream of the region in which the workpieces are delivered onto the conveying flange margin 13*a*. Any workpieces that are not properly in single file alignment are simply diverted back to the rotating bowl before reaching the counter, substantially in the same manner followed in connection with more conventional counting procedures. The system of the invention, however, does not rely upon counting of parts, as such, but only upon the counting of generated pulses, where each pulse represents a predetermined small increment of motion of the conveying flange in a conveying direction. Whenever a light source is interrupted by the presence of a workpiece or a string of contacting workpieces, individual pulses are counted and accumulated, and the completion of a given batch counting operation, representing the counting of predetermined number of workpieces, is indicated when the total pulse count reaches a predetermined number.

While the system of the invention provides for a significant improvement in operating speed compared to more conventional systems, the facilities required are relatively conventional in nature and do not involve significant additional expense.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a system for high speed, high accuracy counting of like workpieces, and of the type comprising conveying means for conveying the workpieces in predetermined alignment and in a single file manner, a sensor for sensing the passage of a workpiece past a predetermined sensing location, and an exit path for workpieces being conveyed beyond the sensor, the improvement characterized by (a) motion signal generating means associated with said conveying means for generating motion signals in response to movement of said conveying means and representing the extent of such movement, (b) said signal generating means generating a plurality of detectable motion signals in response to movement of said conveying means through a distance corresponding to the length of a single workpiece, and (c) a controllable counter for receiving and accumulating a count of motion signals from said signal generating means, (d) at least one of said counter and signal generating means being associated with said sensor, whereby motion signals are counted only while a workpiece is sensed by said sensor.

2. A high speed counting system according to claim 1, for counting workpieces in individual batches of predetermined number, wherein (a) said system includes means responsive to a predetermined total count of accumulated motion signals, corresponding to movement of said conveying means a distance equal to the combined length of said predetermined number of workpieces, to end the count for one batch and ready the system for the counting of a subsequent batch.

3. A high speed counting system according to claim 1, wherein (a) said conveyor means comprises a rotating surface, (b) a confining fence is associated with said rotating surface for the containment of workpieces being conveyed by said surface, and (c) means, including said confining fence and said rotating surface, are provided for causing said workpieces to be conveyed in single-file fashion on said surface.

4. A high speed counting system according to claim 3, wherein (a) said confining fence if formed with an exit opening for the discharge of counted workpieces, (b) said sensor is positioned upstream of said exit opening, in a position to sense the passage of workpieces a short distance in advance of said exit opening, (c) mechanical deflector means are located along the path of workpiece movement, at a location downstream of said sensor, (d) said mechanical deflector means being operable between a retracted position, in which workpieces are permitted to pass through said exit opening, and an active position in which workpieces conveyed by said rotating surface are prevented from passing through said exit opening, and (e) deflector control means are provided for temporarily actuating said deflector means to said active position when said count of accumulated motion signals reaches said predetermined total.

5. A high speed counting system according to claim 4, wherein (a) air jet deflector means are located along the path of workpiece movement, at a location upstream of said mechanical deflector means, (b) said air jet deflector means being actuated by said deflector control means for deflecting workpieces off of said rotating surface in advance of said mechanical deflector means.

6. A high speed counting system according to claim 3, wherein (a) said conveyor means comprising a rotating bowl-like structure, (b) said rotating surface comprises a horizontally disposed flange at an upper edge of said bowl-like structure, and (c) said bowl-like structure containing a supply of workpieces to be counted and means for delivering said workpieces in random order onto said flange.

7. A high speed counting system according to claim 1, wherein (a) secondary conveying means are provided for the discharge of workpieces from said conveying means, (b) said secondary conveying means comprising tubular duct means having entry and exit ends and an intermediate portion, (c) air discharge means for discharging high velocity air flows into an intermediate portion of said tubular duct in a generally downstream direction whereby to create a subatmospheric pressure in upstream portions of said duct and above-atmospheric pressure in downstream portions of said duct.

8. A high speed counting system according to claim 7, wherein (a) secondary counting means is positioned at the discharge end of said duct, (b) said secondary counting means comprises means responsive to the passage of individual, spaced-apart workpieces.

9. A high speed counting system according to claim 8, wherein (a) said secondary counting means is located downstream of said air discharge means.

10. A high speed counting system according to claim 7, wherein (a) said air discharge means comprises a tubular venturi nozzle means forming a portion of said tubular duct.

11. A high speed counting system according to claim 7, wherein (a) a collecting box is connected to the exit end of said of said tubular duct for the reception of workpieces discharged therefrom, (b) said collecting box is of generally closed construction except for bottom wall portions thereof, (c) said bottom wall portions being of perforate construction to accommodate the flow of air through the bottom portions of said box.

12. A high speed counting system according to claim 11, wherein (a) said tubular duct is connected to said collecting box in upper portions thereof spaced above said perforate bottom portions, providing for a generally downward flow of air in said collecting box.

13. A high speed counting system according to claim 12, wherein (a) said perforate bottom portions comprise a pivotally mounted perforate bottom panel, and (b) control means are provided for momentarily opening said bottom panel in response to the total count of accumulated motion signals reaching a predetermined total corresponding to a desired number of workpieces.

14. A high speed counting system according to claim 4, where in (a) said mechanical deflector means are mounted adjacent said confining fence and include a deflector element extendable through an opening in said fence, (b) said deflector element having an end surface which is flush with and form a part of said fence, when said deflector means is in said retracted position, (c) said deflector element extending across said rotating surface, at an angle to the direction of movement thereof, when said deflector means is in said active position, whereby to deflect workpieces off of said rotating surface.

15. A high speed counting system according to claim 1, wherein (a) said sensor comprises a light source and optical switch means for sensing the presence and absence of light from said source, (b) said optical switch means being located remotely from said light source, and (c) optical fiber means connected to said optical switch and having a second end located in position to receive light from said source in the absence of an intervening workpiece.

16. In a system for high speed, high accuracy counting of like workpieces, and of the type comprising a rotating bowl-like element provided with side wall and a generally horizontal conveying flange at the upper edge of said side wall, means for rotating said bowl-like element, a confining fence cooperating with said conveying flange and defining with at least a portion of said flange a flange margin of limited with for the conveyance of workpieces in single file order, said confining fence having a portion defining an exit opening, the improvement characterized by, (a) signal generating means operative in response to increments of rotational motion of said bowl-like element to generate detectable motion signals, (b) sensing means positioned a short distance upstream of said exit opening for sensing the presence of a workpiece at a predetermined location on said flange margin, (c) counter means operative while said sensing means senses the presence of a workpiece to accumulate a count of said detectable motion signals, and (d) means responsive to said count of accumulated motion signals reaching a predetermined number, corresponding to the total length of a predetermined number of workpieces, to initiate a control function.

17. A high speed counting system according to claim 16, wherein (a) said control function comprises temporarily interrupting the conveyance of workpieces to said exit opening.

18. A high speed counting system according to claim 17, wherein (a) said system includes a mechanical diverter element and an air jet diverter device, (b) at least said mechanical diverter element being located between said exit opening and said sensing means, and (c) said air jet diverter device being positioned upstream of said mechanical diverter element, (d) said control function including activating said mechanical diverter element to a position to divert workpieces off of said flange and into said bowl-like element, and activating said air jet device to displace workpieces from said flange and into said bowl-like element in advance of said mechanical diverter element.

19. A high speed counting system according to claim 17, wherein (a) tubular discharge duct means is positioned at said exit opening to receive workpieces passing therethrough and having an entry end and an exit end, and (b) air jet means is associated with said discharge duct means to cause a suction effect at said entry end and a pressure effect at said discharge end.

20. A high speed counting system according to claim 19, wherein (a) a collecting box is connected to the exit end of said discharge duct means for receiving workpieces therefrom, (b) said collecting box is of generally closed construction having air outlet openings in lower portions thereof, and (c) said collecting box has a controllably openable bottom for effecting the periodic discharge of accumulated batches of workpieces.

* * * * *